US008622449B1

(12) United States Patent
Stroh

(10) Patent No.: US 8,622,449 B1
(45) Date of Patent: Jan. 7, 2014

(54) MATERIAL HANDLING SYSTEM

(71) Applicant: Brad Stroh, Waterloo, IA (US)

(72) Inventor: Brad Stroh, Waterloo, IA (US)

( * ) Notice: Subject to any disclaimer, the term of this patent is extended or adjusted under 35 U.S.C. 154(b) by 0 days.

(21) Appl. No.: 13/633,558

(22) Filed: Oct. 2, 2012

(51) Int. Cl.
*B66C 1/00* (2006.01)

(52) U.S. Cl.
USPC ..... 294/67.3; 294/81.5; 294/67.33; 294/81.2

(58) Field of Classification Search
USPC ..... 294/81.5, 67.3, 67.33, 67.1, 81.54, 294/67.4, 81.2, 74
See application file for complete search history.

(56) References Cited

U.S. PATENT DOCUMENTS

| | | | | | |
|---|---|---|---|---|---|
| 1,624,320 | A | * | 4/1927 | Demmer | 452/189 |
| 1,865,739 | A | | 7/1932 | Reinhard | |
| 2,035,311 | A | * | 3/1936 | Galliher | 294/81.2 |
| 2,676,835 | A | | 4/1954 | McKinney | |
| 2,696,317 | A | | 12/1954 | Toffolon | |
| 2,793,905 | A | | 5/1957 | Hillyer | |
| 3,097,011 | A | | 7/1963 | Foster | |
| 3,343,861 | A | * | 9/1967 | Sinicki | 294/81.2 |
| 3,549,190 | A | * | 12/1970 | Caldwell | 294/81.2 |
| 4,162,804 | A | | 7/1979 | Davies | |
| 4,187,711 | A | | 2/1980 | Lavochkin et al. | |
| 4,240,660 | A | * | 12/1980 | Roth et al. | 294/81.2 |
| 4,404,740 | A | | 9/1983 | Hagg et al. | |
| 4,826,228 | A | | 5/1989 | Diniz et al. | |
| 4,969,780 | A | | 11/1990 | Hermsted | |
| 4,973,094 | A | | 11/1990 | Tana et al. | |
| 5,820,184 | A | * | 10/1998 | Echenay | 294/81.2 |
| 5,887,923 | A | * | 3/1999 | Gardner, III | 294/81.55 |
| 6,086,126 | A | | 7/2000 | Krauss | |
| 7,329,082 | B2 | | 2/2008 | Warren | |
| 8,393,659 | B2 | * | 3/2013 | Stroh | 294/67.3 |

* cited by examiner

*Primary Examiner* — Saul Rodriguez
*Assistant Examiner* — Gabriela Puig
(74) *Attorney, Agent, or Firm* — Brett J. Trout P.C.

(57) ABSTRACT

A material handling system for engaging and lifting transformer coils. Four leg assemblies are provided around a transformer. The leg assemblies have extensible plates which extend underneath the transformer. The leg assemblies are secured by chains to an overhead cruciform spacer which is coupled to a crane or other device. The leg assemblies may be bound together by straps to prevent movement of the leg assemblies relative to one another. For smaller or larger transformers, a lesser or greater number of leg assemblies may be used.

17 Claims, 5 Drawing Sheets

10
110
118
86
134
124
98
96
94
84
80
74
108
128
116
88
140
148
126
104
112
90
138
76
148
106
114
92
130
144
148
78
82
68
66
72
70
60
62
28
56
58
26
46
54
48
50
34
36
38
52
20
18
16
14
12
32
152
154
150
22
24
30

MATERIAL HANDLING SYSTEM

This is a Divisional Application based on U.S. Ser. No. 13/065,496, filed Mar. 23, 2011.

TECHNICAL FIELD

The present invention relates in general to a material handling system and, more particularly, to a system for lifting transformer coils.

BACKGROUND

Industrial electrical transformer coils are provided with large windings of a conductive sheet metal. The transformer coils may be constructed of a single wound sheet, or may be constructed of multiple windings. The windings may also form multiple cylinders, which nest inside one another, with the cylinder of windings having the smallest diameter forming the interior of the transformer coil and the cylinder of windings having the largest diameter forming the exterior of the transformer coil. Although large transformer coils can weigh five tons or more, the windings are relatively delicate and subject to damage if the transformer coils are lifted or moved improperly.

It is known in the prior art to provide large, dedicated lifting systems to secure and transport transformer coils. Such systems are useful for dismantling transformers when they have failed to determine the root cause of a transformer failure. To properly diagnose a failure, prior art systems are designed to dismantle the failed transformers with minimal distortion of the transformers" inner coils. While such systems are useful in a closed environment, such as a transformer coil manufacturing facility, such systems are not portable. These lifting systems are also too large and expensive to be used on an installation site.

While it is possible to place a transformer coil on a platform and use prior art technology to lift the platform with the transformer coil provided thereon, such a platform would limit underneath access to the interior of the coil. It would be desirable to provide a system for lifting the transformer coil which left the axial center of the transformer coil exposed, to allow the transformer coil to be positioned over a core leg. While it would be possible to provide an opening in the platform on which the transformer coil is placed, once the transformer coil is positioned over the core leg, it would be difficult to remove the platform from the core leg with the transformer coil in position over the platform.

It is also known in the art to employ screw clamps, such as those described in U.S. Pat. No. 4,404,740 to lift a transformer coil. In this type of system, screw clamps having top and bottom clamps are secured to a transformer coil. Threaded bolts running the length of the screw clamps are used to tighten the screw clamps, drawing the bottoms of the screw clamps toward the tops of the screw clamps, and securing the transformer coil therebetween. A plurality of such screw clamps may be secured to the transformer coil. Chains are thereafter secured to the screw clamps and a crane or other lifting device lifts the chains.

While such systems are useful for the lifting of the transformer coil or maintaining the axial core of the transformer coil exposed so that it may be placed over a core leg, such systems have several drawbacks. One drawback associated with such prior art systems is the difficulty involved with installing the screw clamps. To install the screw clamps, the transformer coil must be lifted a substantial distance to accommodate the bottom of the screw clamps. Additionally, after the screw clamps are provided under and over the transformer coil, the threaded bolts of the screw clamps must be individually tightened to prevent the screw clamps from being dislodged.

Another disadvantage of such systems is that the screw clamps are allowed to move independently of one another, thereby exposing the transformer coil to damage if one of the screw clamps were to fail and the remaining screw clamps not being connected or sufficiently coordinated to accommodate the additional weight the failed screw clamp is no longer able to support. Additionally, once the transformer coil is provided over the core leg, the difficulties associated with attaching the screw clamps exists in reverse, with the transformer coil having to be lifted a substantial distance to remove the screw clamps and the individual threaded rods of the screw clamps having to be individually adjusted to allow the screw clamps to be removed from the transformer coil. The size and complexity of the screw clamps also increases the maintenance and potential failure rate of the entire system.

In material handling situations such as lifting and moving a transformer coil, it would be desirable to provide a lightweight and efficient system for securing a transformer coil, lifting the transformer coil, moving the transformer coil and removing the lifting system once the transformer coil has been positioned as desired. It would also be desirable to provide a lifting system that secured the transformer coil in a manner that adjusted the load in the event of the failure of one portion of the lifting system. It would also be desirable to provide a lifting system that was adjustable to lift a single transformer coil cylinder or multiple transformer coil cylinders without having to completely remove the material handling system from the transformer coil. Furthermore, it would be desirable to provide a material handling system for lifting and moving transformer coils that is of a low-cost, lightweight and low maintenance design.

The difficulties encountered in the prior art discussed hereinabove are substantially eliminated by the present invention.

SUMMARY OF THE DISCLOSED SUBJECT MATTER

Advantageously, in a preferred example of this invention, a material handling system is provided with a plurality of legs secured around an electrical transformer coil with a strap. Each of the legs is provided with a shoe, defining a slot through which is provided an adjustable foot. The foot may be extended or retracted from the shoe a predetermined distance to allow the material handling system to lift one or more cylinders of the transformer coils simultaneously. The legs are coupled to a cruciform spacer by a plurality of lift lines, to allow the lifting system to be lifted by a crane or similar device without causing damage to the transformer coil. Once the transformer coil has been lifted and positioned as desired, the straps and legs may be removed from the transformer coil.

BRIEF DESCRIPTION OF THE DRAWINGS

The present invention will now be described, by way of example, with reference to the accompanying drawings in which.

DETAILED DESCRIPTION OF THE DRAWINGS

Figure 1:
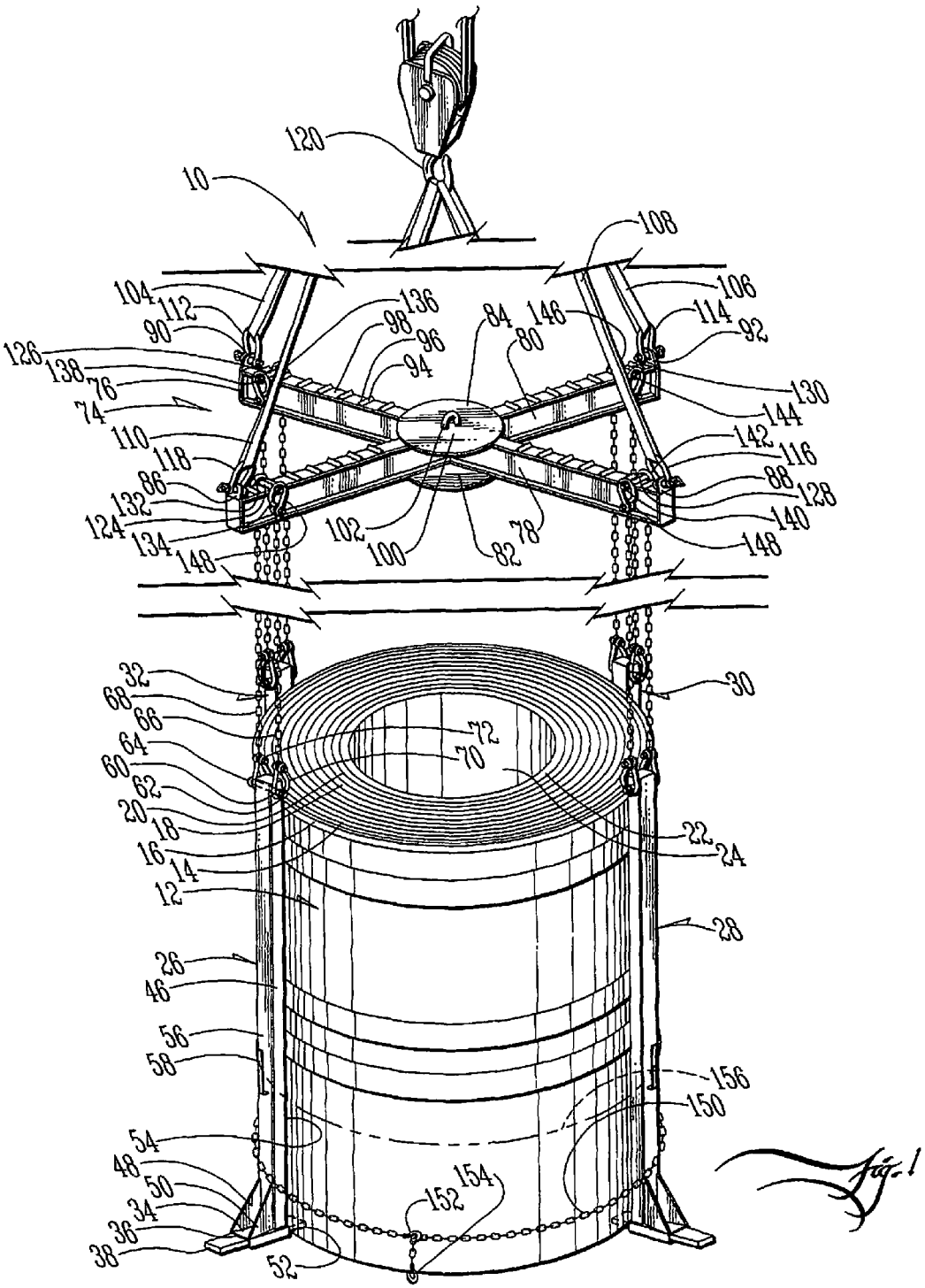
FIG. 1 is a top perspective view of the material handling system of the present invention lifting a coil transformer.
Figure 2:
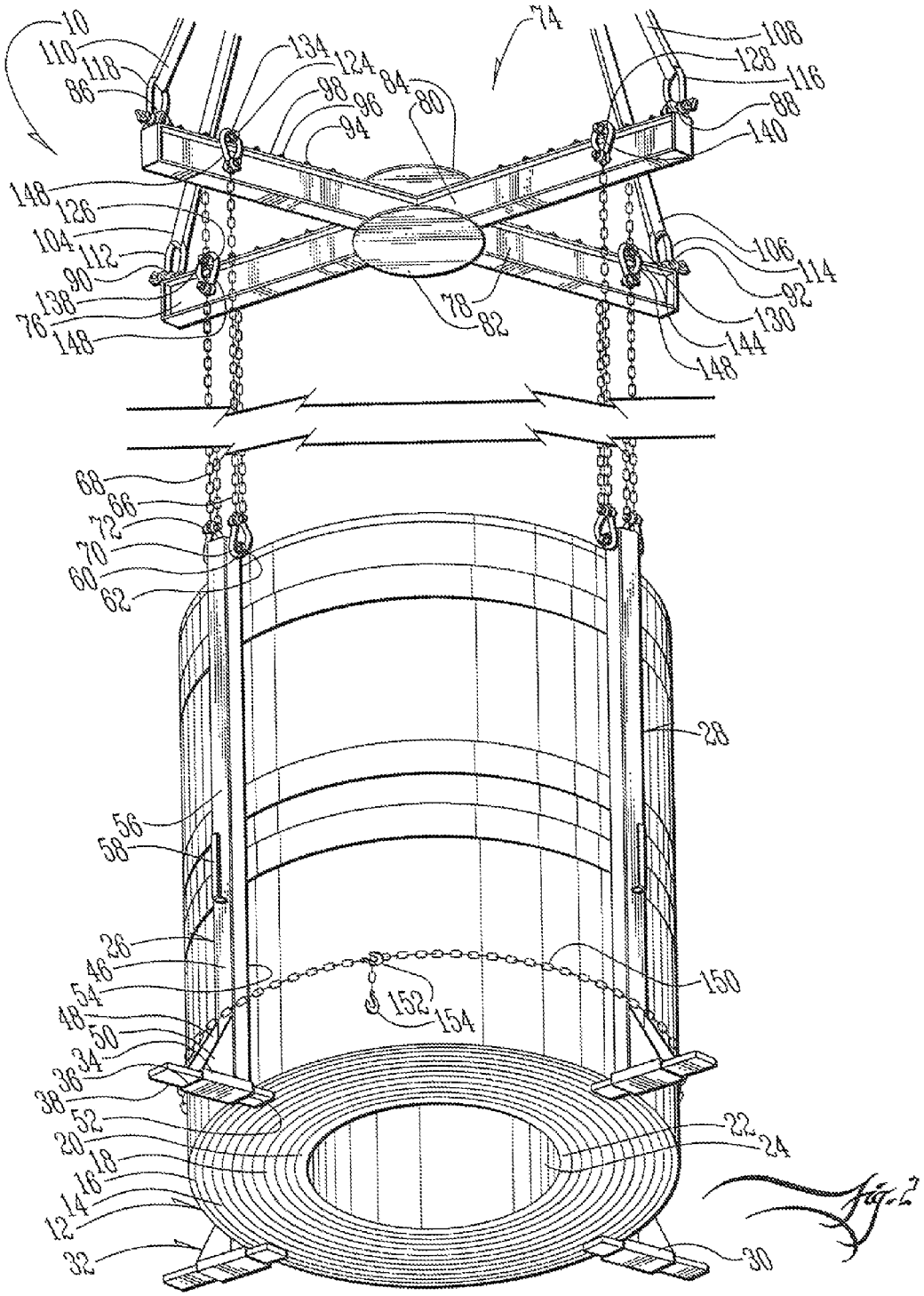
FIG. 2 is a bottom perspective view of the material handling system of the present invention lifting a coil transformer in accordance with one embodiment.
Figure 3:
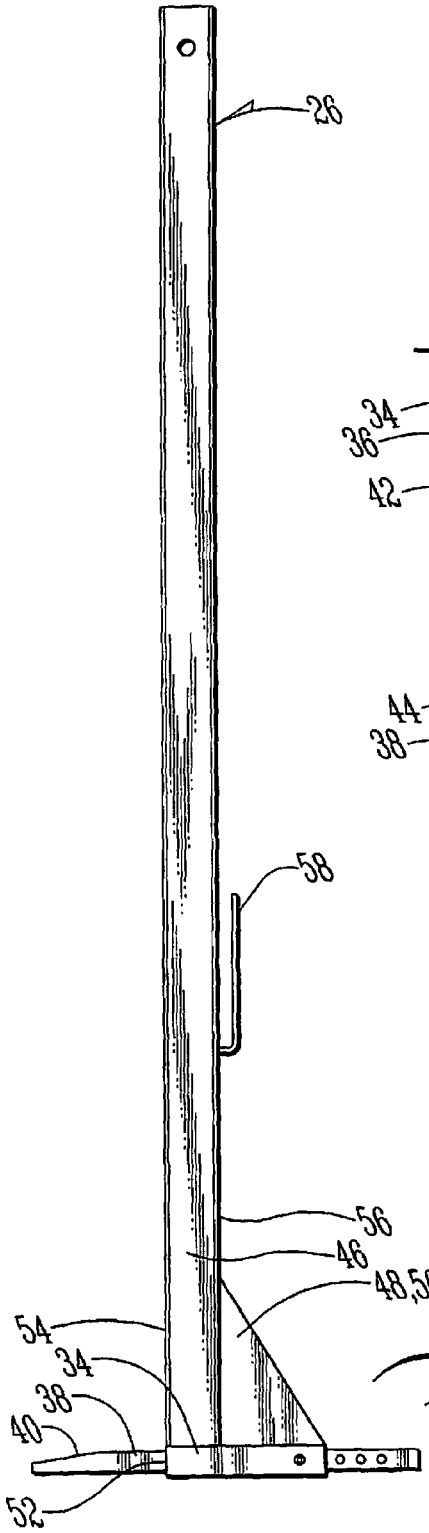
FIG. 3 is a side elevation of the leg assembly of the material handling system of the present invention in accordance with one embodiment.

A material handling system according to this invention is shown generally as (10) in FIG. 1. The system (10) is provided around a transformer coil (12). The transformer coil (12) is constructed of a first winding (14) defining an exterior cylinder (16) having a first interior (18). Provided within the first interior (18) is a second winding (20) defining an interior cylinder (22) having a second interior (24). The material handling system (10) is provided with a first leg assembly (26), a second leg assembly (28), a third leg assembly (30) and a fourth leg assembly (32). As the leg assemblies (26-32) are preferably identical in construction, description will be limited to a first leg assembly (26).

Figure 4:
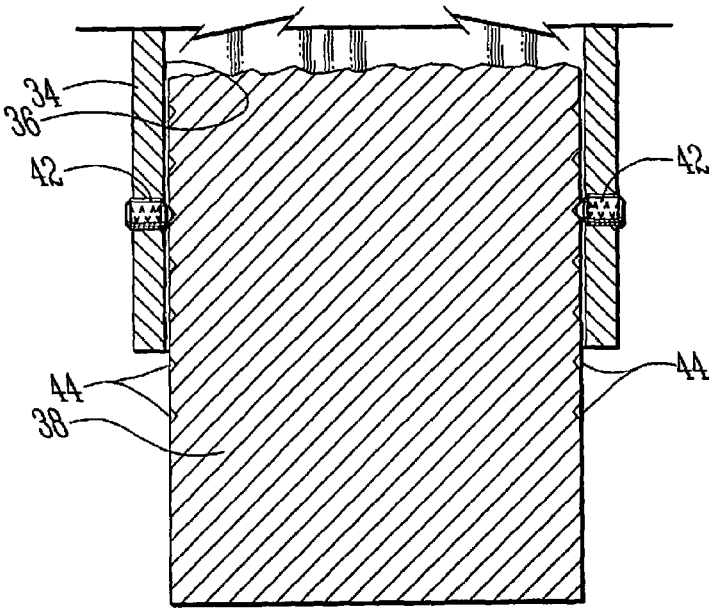
FIG. 4 is a top elevation in cross-section of the interior of the shoe of the leg assembly of the present invention in accordance with one embodiment.
Figure 5:
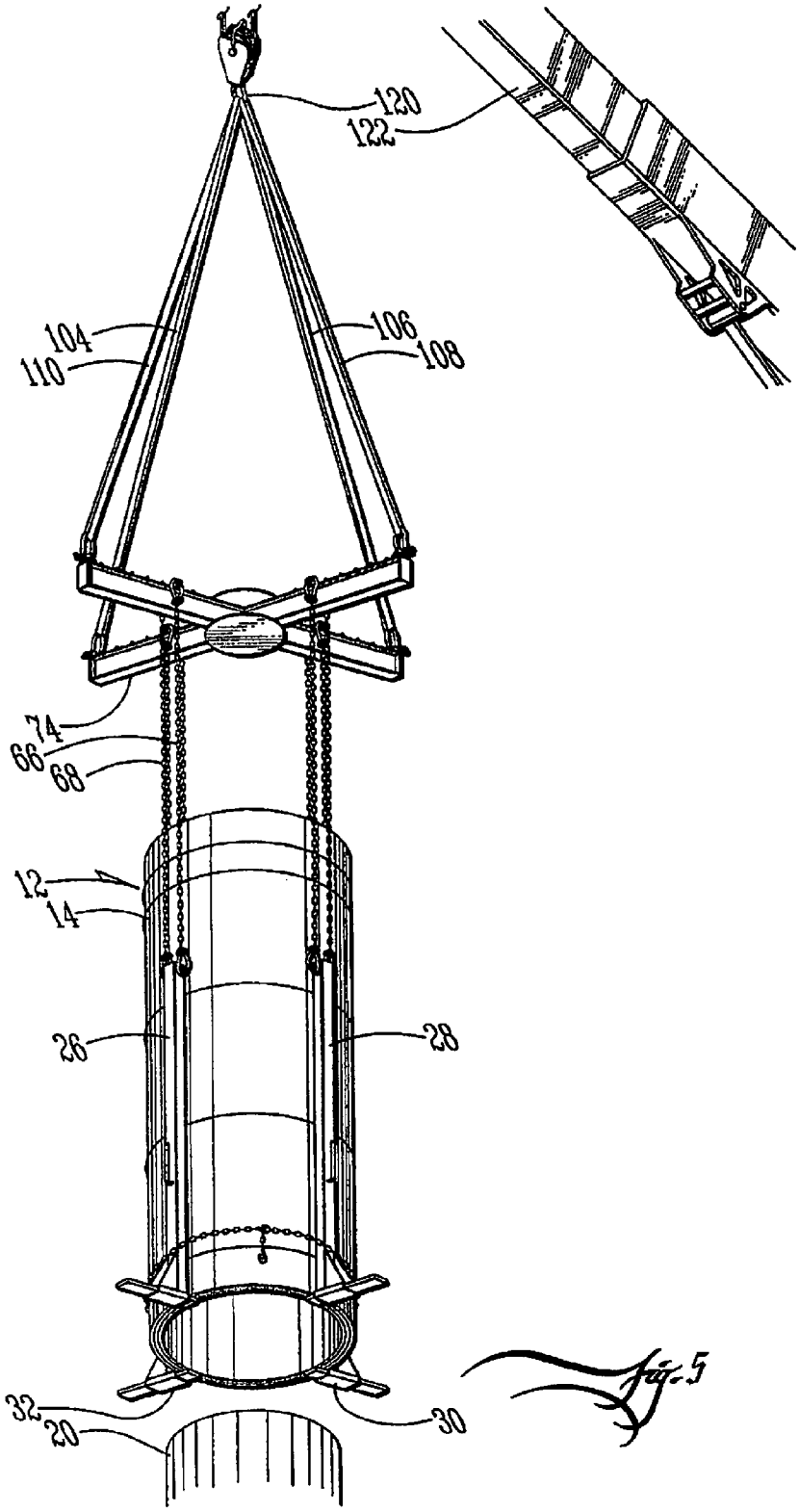
FIG. 5 is a bottom perspective view of the material handling system of the present invention lifting an outer winding of a coil transformer off of an inner winding in accordance with one embodiment.
Figure 6:
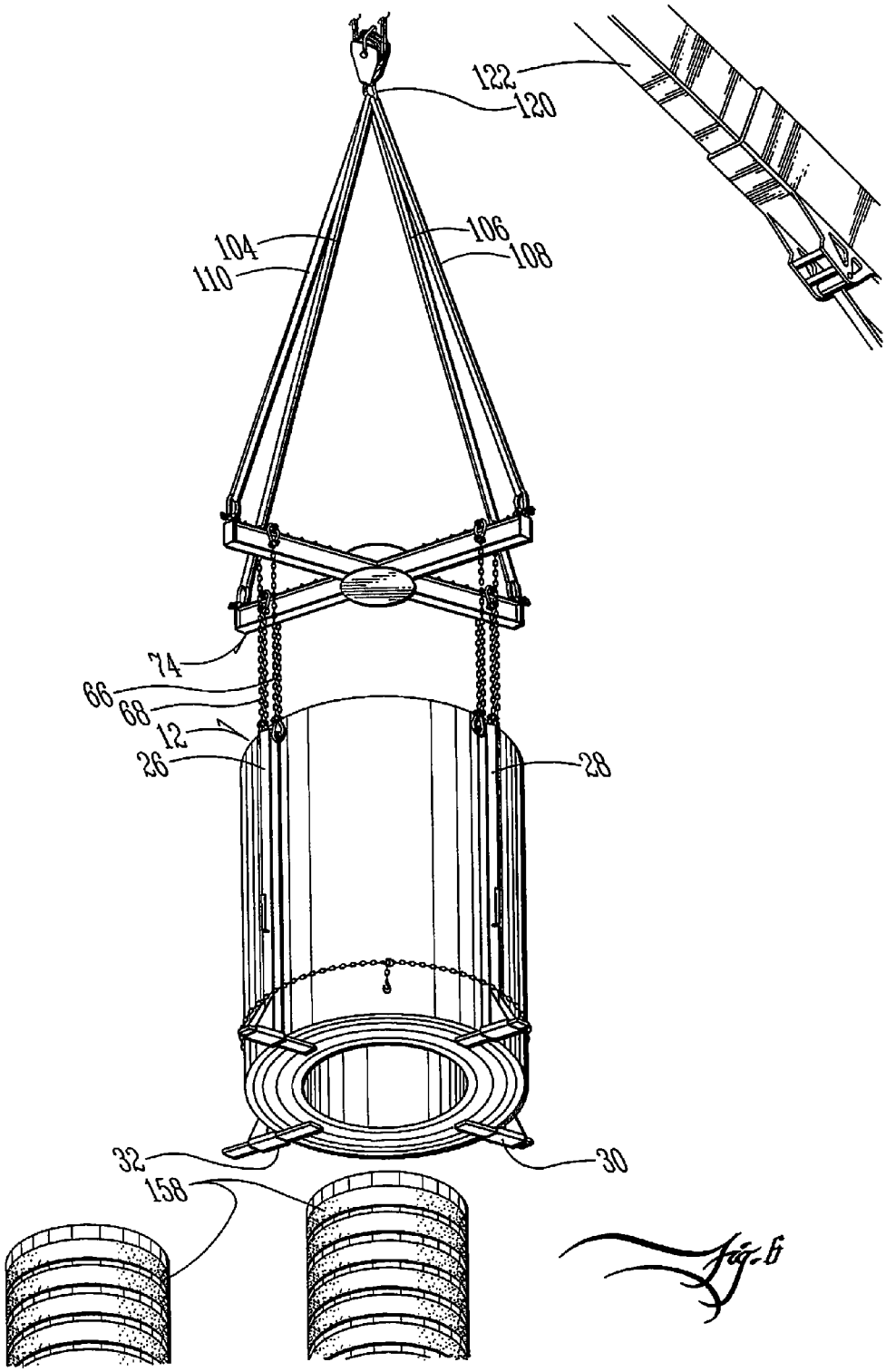
FIG. 6 is a bottom perspective view of the material handling system of the present invention lowering a coil transformer in onto a coil leg in accordance with one embodiment.

The first leg assembly (26) is provided with a coupling, such as a housing or shoe (34) defining a slot (36) of rectangular cross-section, sized to accommodate an extensible plate, such as a foot (38). The leg (26) is preferably between one half and eight meters tall, and more preferably between one and four meters tall. The foot (38) is a steel plate extending from both ends of the slot (36) and provided with an upwardly tapered forward face (40). While the foot (38) is preferably fully slidable within the slot (36) of the shoe (34), the shoe (34) may alternatively be provided with spring-loaded ball detents (42) extending slightly into the slot (36) to receive scallops (44) or other indentations on the foot (38). The detents (42) secure the foot (38) relative to the shoe (34) to allow the foot (38) to extend laterally relative to the leg (46) of the first leg assembly (26) a plurality of predetermined distances. FIG. 4.

The shoe (34) is welded to the leg (46) and is further secured thereto by a buttress, such as a pair of triangular plates (48) and (50) welded to the leg (46) and shoe (34). Preferably, the shoe (34) is welded to the leg (46) in a manner in which the shoe (34) extends laterally rearward relative to the leg (46) but has a forward face (52) coterminous with a forward face (54) of the leg (46). The leg (46) is a hollow steel tube having a rectangular cross-section.

An L-shaped bracket (58) constructed of steel is welded to the rearward face (56) of the leg (46). The top of the leg (46) is provided with a steel rod (60) passing through the leg (46) and provided on each of its threaded ends with a nut (62) and (64). Lift lines, such as a grade 100 lifting chains (66) and (68) are secured to the leg assembly (26). The lifting chains (66) and (68) are provided with slip hooks (70) and (72) which are secured around the threaded rod (60) and prevented from undesired disengagement by the nuts (62) and (64).

As shown in FIG. 1, a spacer (74) is provided above the transformer coil (12). The spacer (74) is constructed of a cruciform configuration of I-beams (76), (78) and (80). The spacer (74) is preferably between one-half and seven meters wide, and more preferably between one and four meters wide. Preferably two shorter I-beams (76) and (78) are welded, or otherwise secured, to a longer I-beam (80) to make the height of the spacer (74) the same as the width. Two circular steel support plates (82) and (84) are welded to the I-beams (76), (78) and (80) to provide the spacer (74) with additional strength. In the preferred embodiment, the spacer (74) is constructed to provide a lifting capacity of between five hundred and one-hundred thousand pounds, more preferably between one thousand and fifty thousand pounds, and most preferably between one thousand and thirty thousand pounds.

Provided on the tops of the I-beams (76), (78) and (80) are four steel hoist rings (86), (88), (90) and (92), welded or otherwise secured to the I-beams (76), (78) and (80). The tops (98) of the I-beams (76), (78) and (80) are provided with a plurality of stops (94) constructed of angle iron to provide the stops (94) with a triangular cross-section and peaks (96) rising approximately one inch from the tops (98) of the I-beams (76), (78) and (80). The stops (94) may be welded or otherwise secured to the tops (98) of the I-beams (76), (78) and (80), and spaced approximately four inches from one another. The center (100) of the spacer (74) may be provided with an additional hoist ring (102), welded or otherwise secured to the top of the support plate (82).

Coupled to the spacer (74) are a plurality of lifting straps (104), (106), (108) and (110). The straps (104-110) are secured to the spacer (74) by shackles (112), (114), (116) and (118) provided through the hoist rings (86), (88), (90) and (92). The straps (104-110) are coupled to the slip hook (120) of a crane (122) or other lifting device. Resting on the I-beams (76), (78) and (80) are steel rods (124), (126), (128) and (130) threaded on each end and provided with nuts (132), (134), (136), (138), (140), (142), (144) and (146), welded or otherwise secured against inadvertent removal from the rods (124-130). Provided over the rods (124) and (130) are slip hooks (148) coupled to the lifting chains (66) and (68). The downward force of the lifting chains (66) and (68) on the rods (124-130) keeps them from becoming dislodged from the spacer (74). The stops (4) keep the rods (124-130) from moving out of position along the I-beams (78), (78) and (80).

As shown in FIG. 1, provided around the leg assemblies (26-32) is a flexible connector such as a strap (150). In the preferred embodiment, the strap (150) is a grade 100 lifting chain provided on each end with a hoist hook (152) and (154). If desired, the strap (150) may be secured within the L-shaped brackets (58) of the leg assemblies (26-32), or the strap (150) may be simply provided around the leg assemblies (26-32), with the triangular plates (48) ad (50) preventing the strap (150) from falling off the leg assemblies (26-32). If desired, the strap (150) may be provided around the end of the leg assemblies (26-32) and a supplemental strap (156) provided in the L-shaped brackets (58).

When it is desired to use the material handling system (10) of the present invention to lift a transformer coil (12), the leg assemblies (26-32) are positioned equal distance around the exterior cylinder (16). The foot (38) of each leg assembly (26-32) is moved a predetermined distance laterally relative to the forward face (54) of each leg (46). The distance which the foot (38) is moved laterally relative to the forward face (54) of the leg (46) is determined by the cylinder (16) and (22) desired to be lifted. If it is desired to lift just the exterior cylinder (16), the forward face (40) of the foot (38) is extended laterally relative to the forward face (54) of the leg (46) almost to the depth of the interior cylinder (22). If it is desired to lift all of the cylinders (16) and (22), the forward face (40) of the foot (38) is extended laterally relative to the forward face (54) of the leg (46) a sufficient distance to support all of the cylinders (16) and (22). The forward face (40) of the foot (38) preferably does not extend into the innermost interior of the innermost cylinder, to allow the transformer coil (12) to be placed over the core leg (158) without impediment by the foot (38). Once the foot (38) of each leg (46) has been positioned as desired under the transformer coil (12), the strap (150) is provided around the leg assemblies (26-32) and secured to itself using the hoist hooks (152) and (154). The supplemental strap (156) may be secured around the leg assemblies (26-32) within the L-shaped brackets (58) of the leg assemblies (26-32).

The slip hook (120) of the crane (122) is coupled to the straps (104-110) and the straps (104-110), in turn, are coupled to the hoist rings (86-92) of the spacer (74) by the shackles (112-118). Depending on the diameter of the transformer coil (12) the rods (124-130) are positioned on top of the I-beams (76-80) equidistant from the center of the spacer (74), and between two adjoining stops (94). For transformer coils (12) having a narrow diameter, the rods (124-130) are positioned closer to the center of the spacer (74) and for transformer coils (12) of a large diameter, the rods (124-130) are positioned further away from the center of the spacer (74). The stops (94) prevent the rods (124-130) from shifting laterally beyond the stops (94) between which they are positioned. The hoist rings (86-92) prevent the rods (124-130) from inadvertently moving off the ends of the I-beams (76-80). The lifting chains (66) and (68) are secured to the threaded rods (124-130) by the slip hooks (148) and are secured to the threaded rods (60) of the leg assemblies (26-32) by the slip hooks (70) and (72).

The material handling system (10) may then be lifted by the crane (122), allowing the transformer coil (12) to be lifted and positioned on or removed from the core leg (158). If it is desired to remove the exterior cylinder (16) of the transformer coil (12) from the interior cylinder (22) of the transformer coil (12), the foot (38) of each leg assembly (26-32) is adjusted accordingly to allow the material handling system (10) to lift the exterior cylinder (16) from the interior cylinder (22) and move to another location. Thereafter, the material handling system (10) may be disengaged from the exterior cylinder (16) and repositioned around the interior cylinder (22). As the interior cylinder (22) is provided with a smaller diameter than the exterior cylinder (16), the rods (124-130) are repositioned on the spacer (74) closer to the center of the spacer (74). The material handling system (10) may thereafter be lifted by the crane (122) to move the interior cylinder (22) to any desired location.

Although the invention has been described with respect to a preferred embodiment thereof, it is to be understood that it is not to be so limited since changes and modifications can be made therein which are within the full, intended scope of this invention as defined by the appended claims. For example, two, three or any desired number of leg assemblies may be used in association with the material handling system of the present invention.

What is claimed is:

1. A material handling system comprising:
(a) a first leg;
(b) a first foot coupled to the first leg;
(c) a second leg;
(d) a second foot coupled to the second leg;
(e) a spacer;
(f) a first stop provided on the spacer;
(g) a second stop provided on the spacer;
(h) a third stop provided on the spacer;
(i) a fourth stop provided on the spacer;
(j) a fifth stop provided on the spacer;
(k) a sixth stop provided on the spacer;
(l) a first lifting assembly coupled to the first leg;
(m) wherein the first lifting assembly is movable between a first position between the first stop and the second stop, to a second position between the second stop and the third stop;
(n) a second lifting assembly coupled to the second leg;
(o) wherein the second lifting assembly is movable between a third position between the fourth stop and the fifth stop, and a fourth position between the fifth stop and the sixth stop;
(p) wherein the spacer is a cruciform
(q) wherein the first lifting assembly comprises:
(i) a lift line coupled to the first leg;
(ii) a rod coupled to the lift line; and
(iii) wherein the rod if posted on top of the spacer; and
(iv) a supplemental lift line coupled to the first leg and to the rod.

2. The material handling system of claim 1, wherein the lift line is coupled to a connector defining an opening.

3. The material handling system of claim 2, wherein the rod extends through the opening.

4. A material handling system comprising:
(a) a first leg;
(b) a first foot coupled to the first leg;
(c) a second leg;
(d) a second foot coupled to the second leg;
(e) a spacer comprising:
(i) a first beam;
(ii) a second beam coupled to the first beam;
(iii) a first stop provided on the first beam;
(iv) a second stop provided on the first beam;
(v) a third stop provided on the first beam;
(vi) a fourth stop provided on the first beam;
(vii) a fifth stop provided on the first beam; and
(viii) a sixth stop provided on the first beam;
(f) a first lifting assembly comprising:
(i) a first lift line coupled to the first leg;
(ii) a second lift line coupled to the first leg; and
(iii) a first rod coupled to the first lift line and the second lift line;
(g) wherein the first rod is movable between a first position between the first stop and the second stop, and a second position between the second stop and the third stop;
(h) a second lifting assembly comprising:
(i) a third lift line coupled to the second leg;
(ii) a fourth lift line coupled to the second leg; and
(iii) a second rod coupled to the third lift line and the fourth lift line;
(i) wherein the second rod is movable between the third position between the fourth stop and the fifth stop, and a fourth position between the fifth stop and the sixth stop.

5. The material handling system of claim 4, wherein the spacer is a cruciform.

6. The material handling system of claim 4, wherein the first lift line is coupled to a first connector, defining a first opening wherein the second lift line is coupled to a second connector, defining a second opening, and wherein the first rod extends through the first opening and the second opening.

7. The material handling system of claim 6, wherein the first rod comprises:
(a) bolt having a threaded first end and a threaded second end;
(b) a first nut threaded onto the first end of the bolt; and
(c) a second nut threaded onto the second end of the bolt.

8. The material handling system of claim 4, further comprising:

(a) a first lifting strap coupled to the first beam; and (b) a second lifting strap coupled to the second beam.

9. The material handling system of claim 8, further comprising a hook coupled to the first lifting strap and to the second lifting strap.

10. A material handling system comprising:

(a) a first leg;

(b) a first foot coupled to the first leg;

(c) a second leg;

(d) a second foot coupled to the second leg;

(e) a cruciform spacer comprising:

(i) a first beam;

(ii) a second beam coupled to the first beam;

(iii) a third beam coupled to the first beam;

(iv) a fourth beam coupled to the first beam;

(v) a first stop provided on the first beam;

(vi) a second stop provided on the first beam;

(vii) a third stop provided on the first beam;

(viii) a fourth stop provided on the first beam;

(ix) a fifth stop provided on the first beam; and (x) a sixth stop provided on the first beam;

(f) a first lifting assembly comprising:

(i) a first lift line coupled to the first leg;

(ii) a second lift line coupled to the first leg; and (iii) a first rod coupled to the first lift line and the second lift line;

(g) wherein the first rod is movable between a first position between the first stop and the second stop, and a second position between the second stop and the third stop;

(h) a second lifting assembly comprising:

(i) a third lift line coupled to the second leg;

(ii) a fourth lift line coupled to the second leg; and (iii) a second rod coupled to the third lift line and the fourth lift line;

(i) wherein the second rod is movable between the third position between the fourth stop and the fifth stop, and a fourth position between the fifth stop and the sixth stop.

11. The material handling system of claim 10, wherein the first stop has a generally triangular cross-section.

12. The material handling system of claim 10, further comprising:

(a) a first lifting strap coupled to the first beam; and (b) a second lifting strap coupled to the second beam.

13. The material handling system of claim 12, wherein the first lifting strap is coupled to the first beam at a first point, wherein the second lifting strap is coupled to the second beam at a second point, wherein the first rod is positioned on the first beam between the first point and the second point, and wherein the second rod is positioned on the second beam between the first point and the second point.

14. The material handling system of claim 13, further comprising a hook coupled to the first lifting strap and to the second lifting strap.

15. A material handling system comprising:

(a) a first leg;

(b) a first foot coupled to the first leg;

(c) a second leg;

(d) a second foot coupled to the second leg;

(e) a spacer;

(f) a first stop provided on the spacer;

(g) a second stop provided on the spacer;

(h) a third stop provided on the spacer;

(i) a fourth stop provided on the spacer;

(j) a fifth stop provided on the spacer;

(k) a sixth stop provided on the spacer;

(l) a first lifting assembly coupled to the first leg;

(m) wherein the first lifting assembly is movable between a first position between the first stop and the second stop to a second position between the second stop and the third stop;

(n) a second lifting assembly coupled to the second leg;

(o) wherein the second lifting assembly is movable between a third position between the fourth stop and the fifth stop, and a fourth position between the fifth stop and the sixth stop (p) wherein the first lifting assembly comprises:

(i) a lift line coupled to the first leg;

(ii) a rod coupled to the lift line; and (iii) wherein the rod is positioned on top of the spacer; and (q) wherein the rod comprises;

(i) a bolt having a threaded first end and a threaded second end;

(ii) a first nut threaded onto the first end of the bolt; and (iii) a second nut threaded onto the second end of the bolt;

(r) wherein the spacer is a cruciform.

16. The material handling system of claim 15, further comprising:

(a) a first lifting strap coupled to the spacer; and (b) a second lifting strap coupled to the spacer.

17. The material handling system of claim 16, further comprising a hook coupled to the first lifting strap and to the second lifting strap.

* * * * *